US007175525B2

(12) United States Patent
Lind

(10) Patent No.: US 7,175,525 B2
(45) Date of Patent: Feb. 13, 2007

(54) GAMING APPARATUS AND METHOD FOR DISPLAYING POTENTIAL RESULTS IN GAMES OF CHANCE

(75) Inventor: Clifton Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 341 days.

(21) Appl. No.: 10/844,115

(22) Filed: May 12, 2004

(65) Prior Publication Data

US 2005/0255902 A1 Nov. 17, 2005

(51) Int. Cl.
*A63F 9/24* (2006.01)

(52) U.S. Cl. ..... 463/17; 463/36; 463/25

(58) Field of Classification Search ..... None
See application file for complete search history.

(56) References Cited

U.S. PATENT DOCUMENTS 5,407,199 A * 4/1995 Gumina ..... 273/139
5,411,271 A * 5/1995 Mirando ..... 463/9
5,871,398 A 2/1999 Schneier et al.
6,524,184 B1 2/2003 Lind et al.
6,572,471 B1 * 6/2003 Bennett ..... 463/16
6,645,074 B2 11/2003 Thomas et al.
6,899,618 B2 * 5/2005 Colin et al. ..... 463/11
7,004,834 B2 * 2/2006 Walker et al. ..... 463/16

* cited by examiner

*Primary Examiner*—Mark Sager
(74) *Attorney, Agent, or Firm*—Russell D. Culbertson; The Culbertson Group, P.C.

(57) ABSTRACT

A method includes first revealing a limited set of potential game results to a player through a player terminal and then presenting the player with a set of graphic representations through the player terminal. Each respective representation has no apparent relationship to any particular potential result in the limited set of potential results. Thus, the player who is presented with the graphic representations cannot tell if any particular one of the representations is tied in any way to any particular potential result in the limited set of potential results. After presenting to the player the set of representations, the player is allowed to select at least one of the representations by making a player choice input through the player terminal. In response to the player choice input, at least one of the potential results in the limited set of potential results is assigned to the player, and this assigned potential result becomes the player's result for the game.

21 Claims, 7 Drawing Sheets

GAMING APPARATUS AND METHOD FOR DISPLAYING POTENTIAL RESULTS IN GAMES OF CHANCE

TECHNICAL FIELD OF THE INVENTION

This invention relates to electronically implemented games of chance such as electronic lottery games, electronic bingo games, and video slot machines. More particularly, the invention relates to electronically implemented games of chance that provide for active player participation. The invention includes gaming methods and apparatus. The invention also encompasses program products for implementing the gaming methods.

BACKGROUND OF THE INVENTION

Games of chance have become popular in many jurisdictions as a way of generating revenue for funding schools and other state and local government services. Many jurisdictions have authorized games of chance such as lottery games, bingo games, video card games, and slot machines. All of these types of games may be played at gaming machines or terminals that include one or more video displays for displaying game graphics, results, and facilitating other interaction with the player. These video display-implemented games offer great flexibility in how the games may be played and how results are displayed to the players. Thus, games have become more and more entertaining and exiting for players. With intense competition in the industry, game suppliers and operators are constantly searching for new and more entertaining games or game presentations.

One common technique for increasing the entertainment value associated with a game is to provide the player with various types of interactions in the game process. That is, rather than simply enabling a player to make a single input and obtain a result as in traditional slot machines, a game may be configured to enable a player to make choices in the course of the game presentation that may or may not affect the outcome of the particular game play. Another popular technique to increase player interaction in a game is to offer a bonus round in conjunction with a base game. Bonus rounds may offer further choices to the player and further entertaining graphics.

An example of a gaming system in which a player is offered a choice in the course of the game is seen in U.S. Pat. No. 5,871,398 to Schneier, et al. This patent discloses an electronically implemented lottery system in which a player is allowed to make a selection in the course of the game to affect the outcome of a play. In particular, U.S. Pat. No. 5,871,398 discloses a lottery system in which players make a selection from among a number of game play outcomes with each outcome representing a distinct chance in the game. Thus, even though the lottery results are themselves predetermined, the player's choice in the game affects the outcome for that particular play.

U.S. Pat. No. 6,645,074 to Thomas et al., provides an example of a gaming system offering bonus round play in which a player may make choices that affect the outcome of the bonus round. In particular, U.S. Pat. No. 6,645,074 discloses a bonus round game in which a player is presented with a grid of locations with each location concealing either a prize or a symbol. The player makes selections from the grid of locations until selecting a location associated with a game ending symbol. The player may win any prizes revealed prior to the game ending event. Prizes associated with grid locations remaining unselected at the end of the game are revealed to the player. This step of revealing unselected prizes is a common step, long used in games such as those played on the game show "Let's Make a Deal" dating back to the early 1960's.

SUMMARY OF THE INVENTION

The present invention provides a method for electronically implemented games that reveals the potential results associated with a game play and also allows the player to select from among different game play records. The present invention also encompasses apparatus and program products for implementing this gaming method.

A method embodying the principles of the invention includes first revealing a limited set of potential game results to a player. This limited set of potential results is revealed to the player through a player terminal display associated with a player terminal. The set of potential results is "limited" in that it is preferably not merely a listing of all of the results available in the game, but some subset of results available in the game. In any case, a method embodying the principles of the invention also preferably includes presenting the player with a set of graphic representations. Each respective representation is presented through the player terminal display and has no apparent relationship to any particular potential result in the limited set of potential results. Thus, the player who is presented with the graphic representations cannot tell if any particular one of the representations is tied in any way to any particular potential result in the limited set of potential results.

After presenting to the player the limited set of potential results and the set of representations, one preferred method according to the invention includes enabling the player to select one of the representations. This selection is made by making a player choice input through the player terminal. In response to the player choice input, at least one of the potential results in the limited set of potential results is assigned to the player, and the assigned potential result or results become the player's result for the game.

A method according to the present invention allows the player at a player terminal to see the results they might win for a given game play, that is, the limited set of potential results, and then allows the player to make some choice that results in the player being assigned preferably one of those potential results as the actual result for the player in a game play. Of course, since the representations from which the player chooses have no apparent relationship to the potential results, the player cannot tell which representation to choose to obtain the best potential result, or any potential result for that matter. This process of presenting the player with their potential results prior to the player's choice in the game can generate considerable excitement considering that the potential results may vary widely. For a given play in which the limited set of potential results includes a large prize, the player will know that their choice could result in their receiving the large prize.

A gaming system embodying the principles of the invention includes at least one player terminal, and preferably many player terminals networked together for various purposes, each player terminal having a display and a player input device. The player input device associated with a respective player terminal enables a player to initiate a game play request and a player choice input. A gaming system according to the present invention also includes a potential result assignment arrangement which defines the limited set of potential results and directs the player terminal to reveal each potential result in the limited set of potential results in response to a game play request. A representation control arrangement is included in the gaming system for directing the player terminal display to display the set of representations, and a result assignment arrangement assigns one or more game play results to the player in response to the player choice input.

The present invention also encompasses a program product made up of potential result assignment program code, representation control program code, result assignment program code, and player terminal program code. The potential result assignment program code functions to define the limited set of potential results, produces a potential result reveal command for a player terminal, and causes the potential result reveal command to be communicated to the player terminal. The representation control program code produces a representation display command for the player terminal and causes the representation display command to be communicated to the player terminal. Assignment of game results to the player terminal is performed by the result assignment program code in response to a player choice input from the player terminal. The player terminal program code directs the display associated with the player terminal to reveal the limited set of potential results to the player in response to the potential result reveal command, directs the display of the representations in response to the representation display command, and directs the display of the assigned results in response to the player choice signal from the player terminal.

These and other advantages and features of the invention will be apparent from the following description of the preferred embodiments, considered along with the accompanying drawings.

DESCRIPTION OF PREFERRED EMBODIMENTS

The present invention will be described below with reference to a particular electronic lottery-type implementation using a particular arrangement of hardware and data structures. This implementation includes a hardware arrangement similar to that described in U.S. Pat. No. 6,524,184 issued on Feb. 25, 2003. The entire content of U.S. Pat. No. 6,524,184 is incorporated herein by this reference. However, it will be appreciated that the present invention is by no means limited to lottery-type gaming systems or to this particular arrangement of hardware, the methods implemented in the hardware, or the example data structures described below. Numerous variations on this implementation are possible within the scope of the present invention. In particular, the results available in a gaming system and method according to the present invention may be derived from a bingo game rather than an electronic lottery game. Results may even be generated from a suitable random or pseudo random number or result generator.

Figure 1:
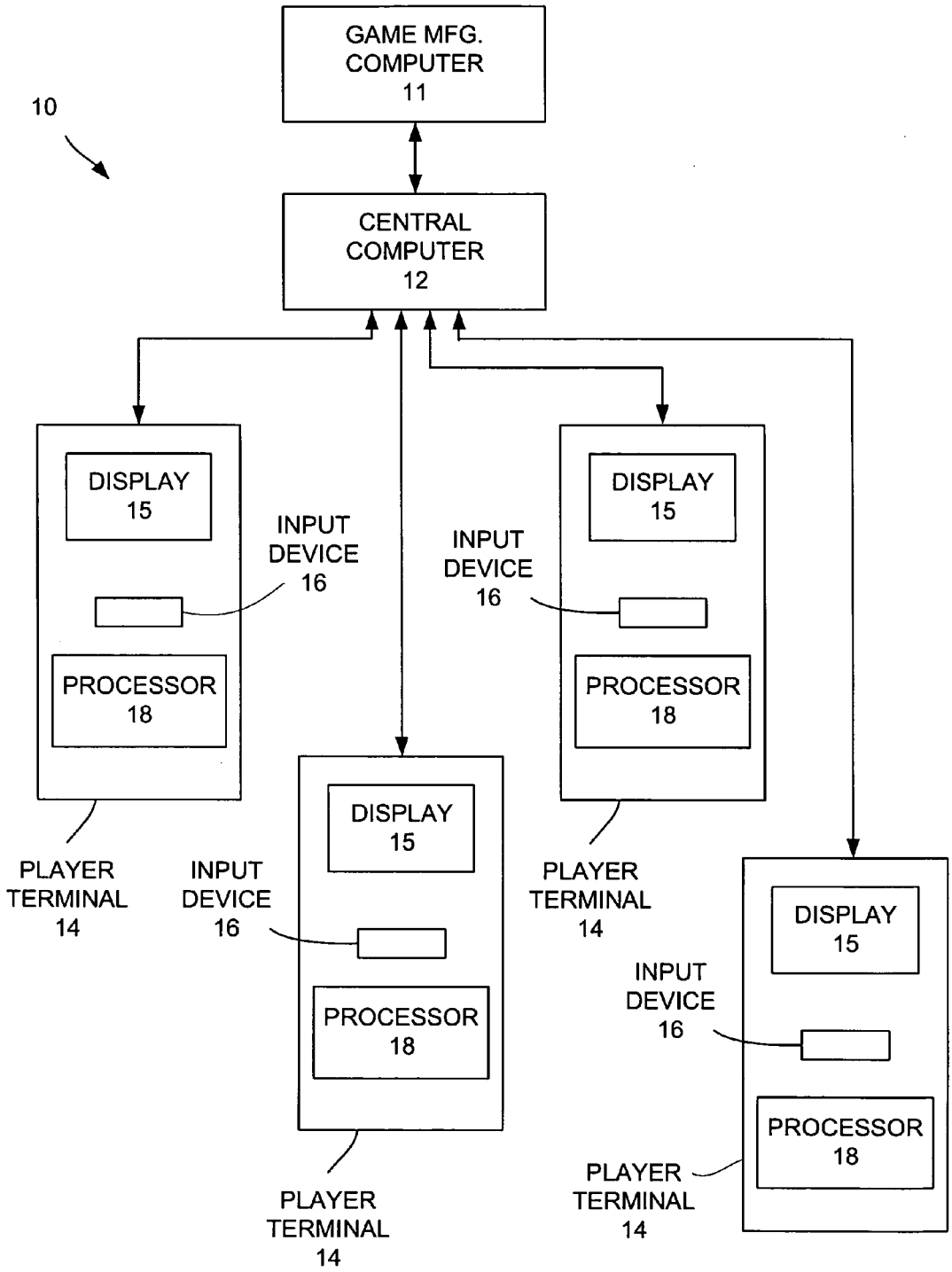
FIG. 1 is a diagrammatic representation of a gaming apparatus embodying one preferred form of the invention.

Referring now to FIG. 1, a gaming apparatus 10 embodying the principles of the invention includes a game manufacturing computer or system 11, a central computer or system 12 in communication with game manufacturing system 11, and a number of player terminals 14 each in communication with central system 12. In this particular lottery-type embodiment, pools of game play records are created at game manufacturing system 11 and then stored in a storage device, such as a hard drive (not shown separately), that is associated with the game manufacturing system. The pools of game play records are transferred periodically to central system 12. Game play records are then allocated or assigned from central system 12 in response to game play requests from player terminals 14. In one preferred form of the invention, manufacturing system 11 produces very large pools of game play records according to a particular game payout, hold, and win distribution design, and then divides each pool into a number of randomized game record subsets which preferably do not include any predetermined number of winning or losing game play records or any particular winning or losing game play record distribution. These subsets of game records are then transferred to central system 12 in order to ensure a supply of game play records at the central system sufficient to satisfy the game play requests incoming from the various player terminals 14.

Each player terminal 14 includes a display 15 for displaying various game representations or graphics, including the set of representations from which a player makes their selection as will be discussed further below. An input device 16 receives player inputs, including game play requests and player choice inputs. The input device may include any type of input arrangement including one or more push buttons, keys, or lever activated switches. Also, the input device 16 may include a touch screen and thus be integrated with display 15. Although not shown in the drawings, each player terminal 14 may also include an arrangement for receiving payments from a player and an arrangement for making payouts to the player. Payouts may be made using a coin or token dispensing arrangement (not shown) included in player terminal 14. Alternatively, or in addition to a coin or token dispensing arrangement, player terminal 14 may include a printer (not shown) for printing a ticket or voucher showing the players's winnings or account value. The player may redeem this ticket through a game operator, for example, or use the ticket in another gaming terminal. In yet other arrangements, wagers and winnings may be tracked through a suitable player account arrangement included in apparatus 10, and a player may redeem their account through a system cashier or through some other suitable account interface arrangement.

The player terminals 14 shown in FIG. 1 also each include a processor 18 for executing player terminal program code which drives or communicates with the various other devices included in the respective player terminal, and directs communications to and from the respective player terminal. Other forms of the invention may perform some or all of this game processing at a central computer system such as system 12. However, it is convenient with present technology to distribute player terminal control to the player terminal itself as opposed to handling player terminal control from a remote device. In any event, the invention is not limited to any particular processing arrangement or division of processing tasks between the player terminals 14 and remote systems such as central computer system 12.

Methods of producing pools of game play records for a lottery-type game are well known in the art and will not be discussed in detail here so as not to obscure the invention in unnecessary detail. In lottery-type games, it will be appreciated that the game play records are usually assigned to players randomly. This randomization may be accomplished generally in one of two ways. One method for ensuring game play records are assigned randomly is to randomize the order of game play records in the pool or pool subsets and then assign game play records sequentially from the randomized game play records. The second common method for ensuring game play records are assigned in random order is to randomly assign game play records from an ordered or unrandomized pool or subset of game play records. Further details on one preferred structure of the game play record pools or pool subsets and a preferred structure of the game play records themselves will be described below with reference to FIG. 2.

Those skilled in the art will appreciate that the invention may be embodied in many arrangements other than the illustrative arrangement shown in FIG. 1. For example, a single computer system may generate the game play records according to the invention and may also store the game play records for distribution to several player terminals such as terminals 14. Pools or pool subsets of game play records may also be stored at a respective player terminal for use in satisfying game play requests according to the invention. Furthermore, it will be appreciated that although four player terminals 14 are shown in FIG. 1 for purposes of illustrating the invention, any number of player terminals may be included in an apparatus embodying the principles of the invention. In yet other arrangements within the scope of the present invention, a single computer system could perform the game play record generation function, the game play record storage function, and player interaction function, thus replacing the separate systems 11, 12, and 14 shown in FIG. 1. These alternative arrangements are to be considered equivalent to the arrangement shown in FIG. 1. Furthermore, there may be wide variation within the scope of the present invention in the specific components included even in the basic arrangement of systems shown in FIG. 1. For example, central computer system 12 may in fact be made up of several different processing systems rather than a single computer. In one preferred form of the invention, central system 12 includes a separate processing device programmed to receive and respond to game play requests and a separate processing device programmed to implement databases for supporting the operation of the processing device for servicing game play requests.

Figure 2:
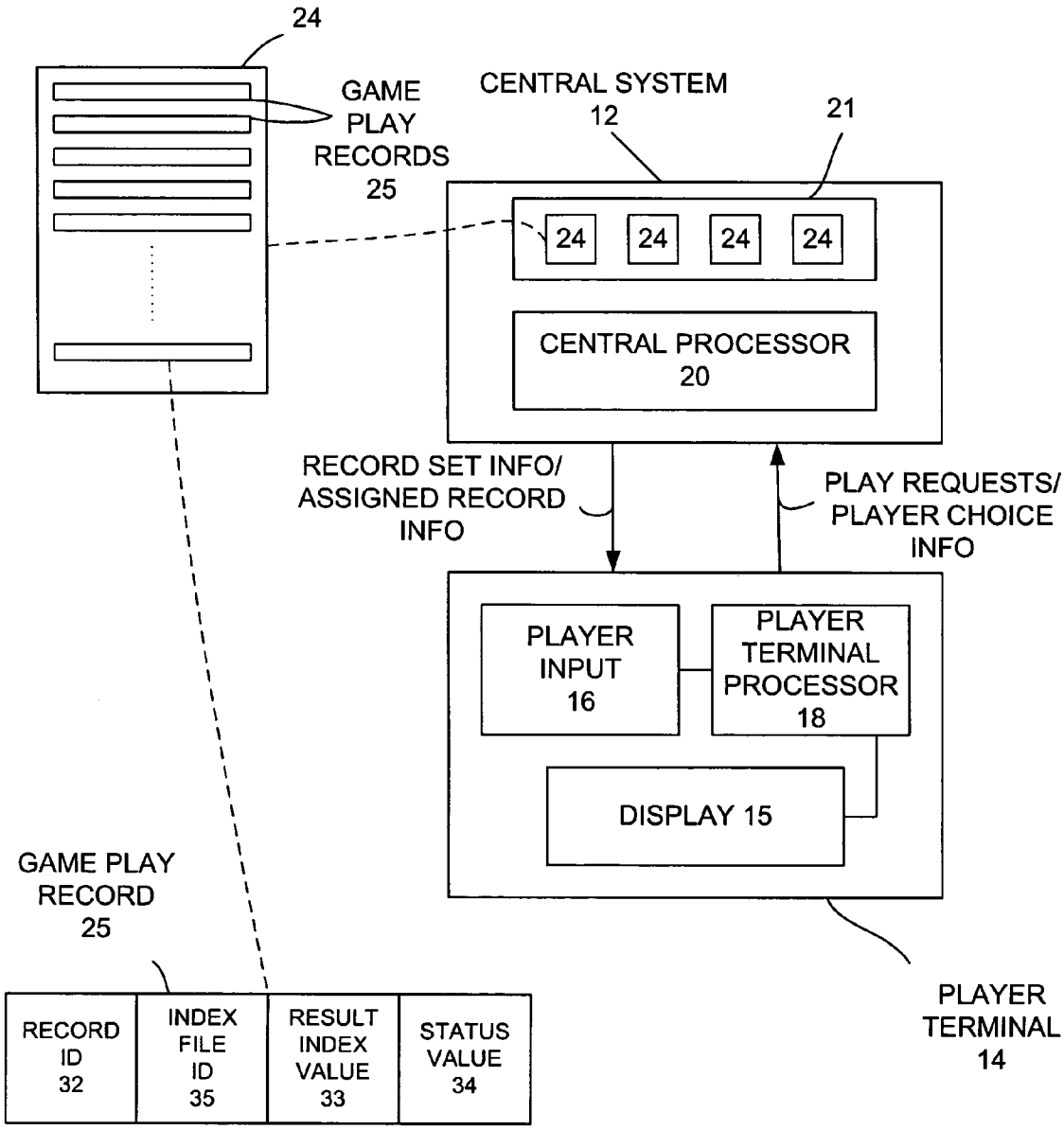
FIG. 2 is a diagrammatic representation of the central processing system and a single player terminal as shown in FIG. 1, along with data structures employed in one preferred form of the invention.

Referring to FIG. 2, central system 12 includes a central processor 20 and a game play record file storage device 21. Those skilled in the art will appreciate that random access memory and other components will be associated with central processor 20 even though these additional components are omitted from the drawing so as not to obscure the invention in unnecessary detail. Central processor 20 executes program code to perform certain method steps described below with reference to FIG. 3. In one preferred form of the invention, central processor 20 in central system 12 executes program code to define a limited set of potential results, to assign at least one game play record from the set to serve as the game result in response to a player choice input, and the making of unassigned game play records available for use in satisfying a future game play request. Central processor 20 may also execute program code to produce a representation display command for a given player terminal 14 which directs the player terminal to display the representations from which the player may make their selection. In this preferred form of the invention, central system 12 represents a potential result assignment arrangement, a representation control arrangement, a result assignment arrangement, and a record collection arrangement. However, it will be appreciated that other preferred forms of the invention may distribute the record allocation, assignment, and collection functions differently Thus, one or more other components in a system according to the present invention may represent the potential result assignment, result assignment, representation control, and collection arrangements. In particular, the representation control for each respective player terminal 14 may be implemented through the respective player terminal itself.

Each player terminal 14 is connected for communication with central system 12 so that information may be communicated from the player terminal to the central system and so that information may be communicated from the central system to the player terminal. The specific types of communications required in a system according to the invention will vary from implementation to implementation. However, the communication arrangement required for the lottery-type system preferably at least supports the communication of game play requests and player game play record selection information from the respective player terminal 14 to central system 12, and the communication of assigned game play record information from the central system to the respective player terminal. Specific examples of communications between a player terminal 14 and central system 12 in the lottery type example system will be described below.

In the exemplary lottery-type form of the invention illustrated in FIG. 2, storage device 21 at central system 12 stores a number of game play record files 24 that have been obtained preferably from the game manufacturing system 11 shown in FIG. 1, or from some other suitable source. Each game play record file 24 includes a number of separate game play records 25. Each game play record file 24 may also include header information regarding the contents and source of the respective file and allowing each respective file to be identified and addressed. As mentioned previously, in preferred forms of lottery-type systems, each file 24 comprises a subset of game play records from a larger pool of game play records. A preferred game play record structure includes the record identifier 32, a result index value 33, a status value 34, and an index file identifier 35. The order in which these elements are shown in FIG. 2 is shown only for purposes of example, and any other order may be used within the scope of the invention. Also, the manner in which these values or identifiers are included in each game play record 25 is subject to wide variation within the scope of the invention. In one form of the invention for example, the identifiers or values are simply arranged in comma delimited fields in each game play record.

Record identifier 32 is preferably unique to each game play record 25 in the respective file 24 so that the record may be addressed in the respective file by the identifier. Alternative forms of the invention may include a sequence value (not shown) in each game play record 25 as a substitute or alternative means for addressing a respective game play record. Result index value 33 is the element from game play record 25 that represents the particular result of the game play record in the preferred lottery-type form of the invention. Each possible result index value 33 is correlated to a result in the game and thus indicates whether a particular game play record is associated with a predetermined winning or losing outcome and the corresponding prize amount, if applicable. Alternative forms of lottery-type systems may use an actual result value in the respective game play record, rather than using the result index value 33 to identify the result value or in addition to using the result index value. Status value 34 is included in the illustrated implementation to indicate the status of the respective game play record as "valid" or "invalid." These designations valid and invalid or some other suitable designations are used in one preferred form of the invention to indicate whether the particular game play record is or is not available to be allocated to define a limited set of potential results. In one preferred form of the invention, the status value comprises a single bit. Index file identifier 35 is included in the illustrated lottery-type example to identify a particular result index file to which the respective result index value belongs. In forms of the invention using a result index value and an index file value, both of these values are used to identify the particular result associated with the game play record.

It will be appreciated that numerous different data structures may be used for game play records in a lottery-type gaming system within the scope of the invention. The particular game play record structure shown in FIG. 2 follows a philosophy of including a minimum amount of data in each game play record. Alternative forms of the invention may utilize game play records that include additional data, such as data necessary to produce graphics to represent the result of the game play record to the player at player terminal 14. Also, it will be appreciated that status information regarding each game play record need not be maintained in the respective game play record itself. Rather, a separate file or data table may be used to maintain status information for each game play record in a game play record file.

It should be borne in mind also that the present invention is by no means limited to lottery-type gaming systems. Rather, the results or potential results used in the present invention may be produced from bingo games or games similar to bingo, or even at random from a suitable random or pseudo random number/result generator. Again, the lottery-type gaming system described herein provides simply a convenient platform for describing the features of the present invention.

Player terminal processor 18 may execute computer program code to allow a player to make game play requests and to produce graphic display commands to cause display 15 to produce suitable displays in response to the potential result reveal command, the representation display command, and game results from central system 12. Display 15 may be used to produce any number of game presentations under the control of the display driving or controlling program code. In particular, it should be noted that a gaming system such as that illustrated in FIGS. 1 and 2 according to the present invention may include player terminals 14 that provide many different types of game presentations. The different game presentations may require presentation-specific game play records. Alternatively, a single game play record file 24 may be used in some forms of the invention to satisfy game play requests from player terminals 14 implementing different game presentations. Game presentations that may be used with the present invention include presentations that mimic paper lottery games, card games such as poker or black jack, reel-type games (slot machines), contests such as horse or dog races, or any other type of game. Where the graphic representation includes a representation of a scratch-off ticket, for example, the information required to produce a graphic representation may include a file or object to generate the basic ticket graphic, and files or objects to draw any symbols which may appear on the ticket. It will be appreciated that the data storage arrangement (arrangement of random access memory, read only memory, and hard drives, for example), associated with player terminal processor 18 has the ability to store all the information required to produce such a graphic representation.

Player input device 16 may include any suitable arrangement to allow the player to make game play requests. Regardless of the specific hardware arrangement used to allow a player to initiate a game play request (buttons, switches, cursor controller/display combination, or touch screen display, for example), the player terminal processor 18 preferably responds to a game play request input from the player by generating a game play request that includes sufficient information to allow the central system 12 to respond appropriately. In the lottery-type gaming system, for example, the game play request may include a game play record file type identifier that identifies the type of game play record file 24 that must be used to satisfy the game play request. Central computer system 12 may then use this game play record file type identifier to identify a particular game play record file 24 that will supply game play records 25 to satisfy the game play request. A game play request that is communicated to some element outside the player terminal to obtain potential and actual result information will also generally include some identifier indicating which player terminal 14 is originating the request, and perhaps other information.

FIG. 2 also shows several different game play record files 24 stored at storage device 21. This reflects the fact that multiple lottery-type games may be in play at any given time in the present system, with each game having its own game play record file 24. Even with one game in play, two or more different game play record files 24 may be used alternately or in combination in accessing game play records 25. Where multiple game play record files are used, central processor 20 is able to distinguish between files and choose the correct file or files in response to a play request from player terminal 14 using information included or associated with the game play request.

Figure 3:
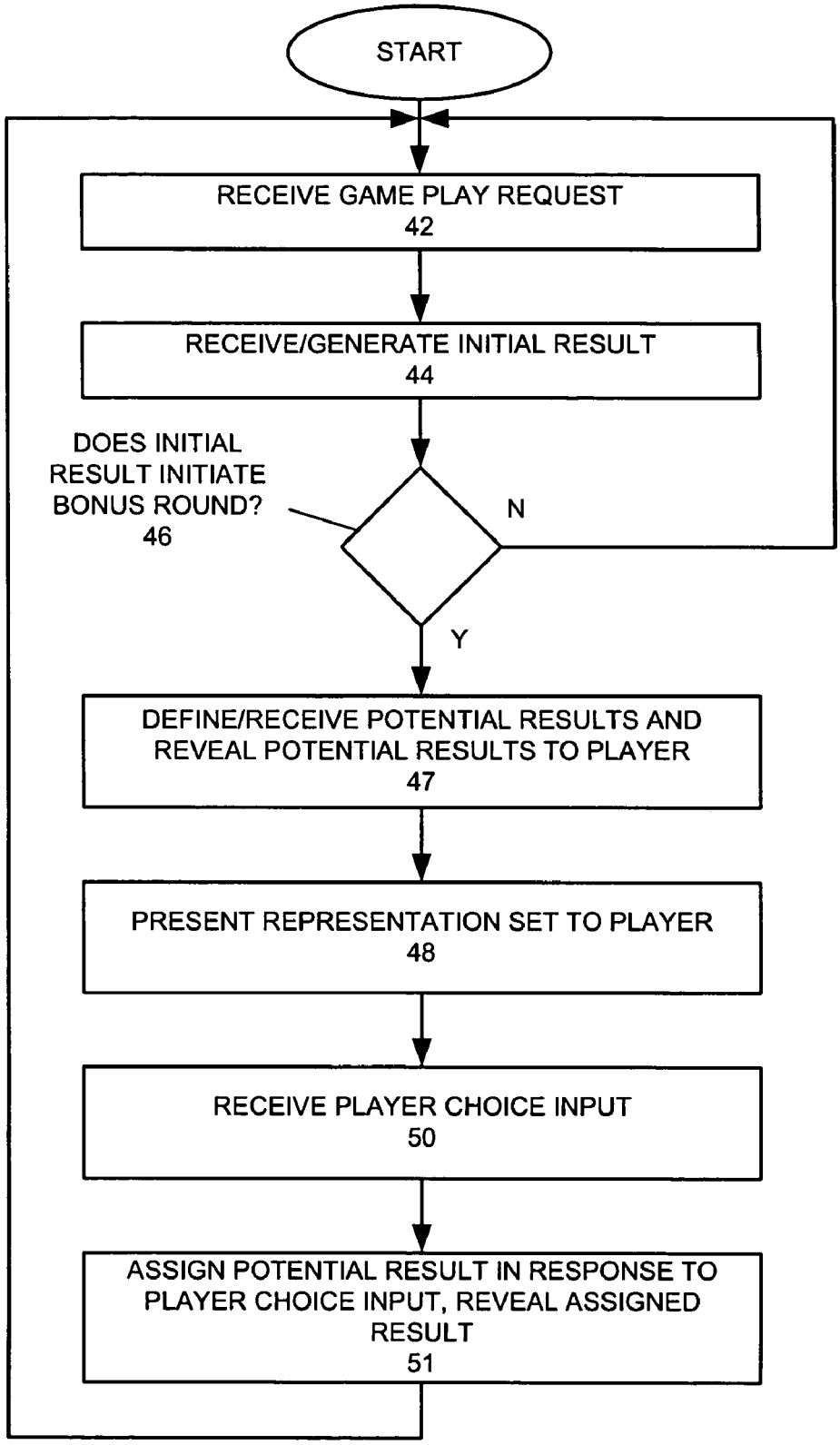
FIG. 3 is a flow chart illustrating a gaming method embodying the principles of the invention.
Figure 4:
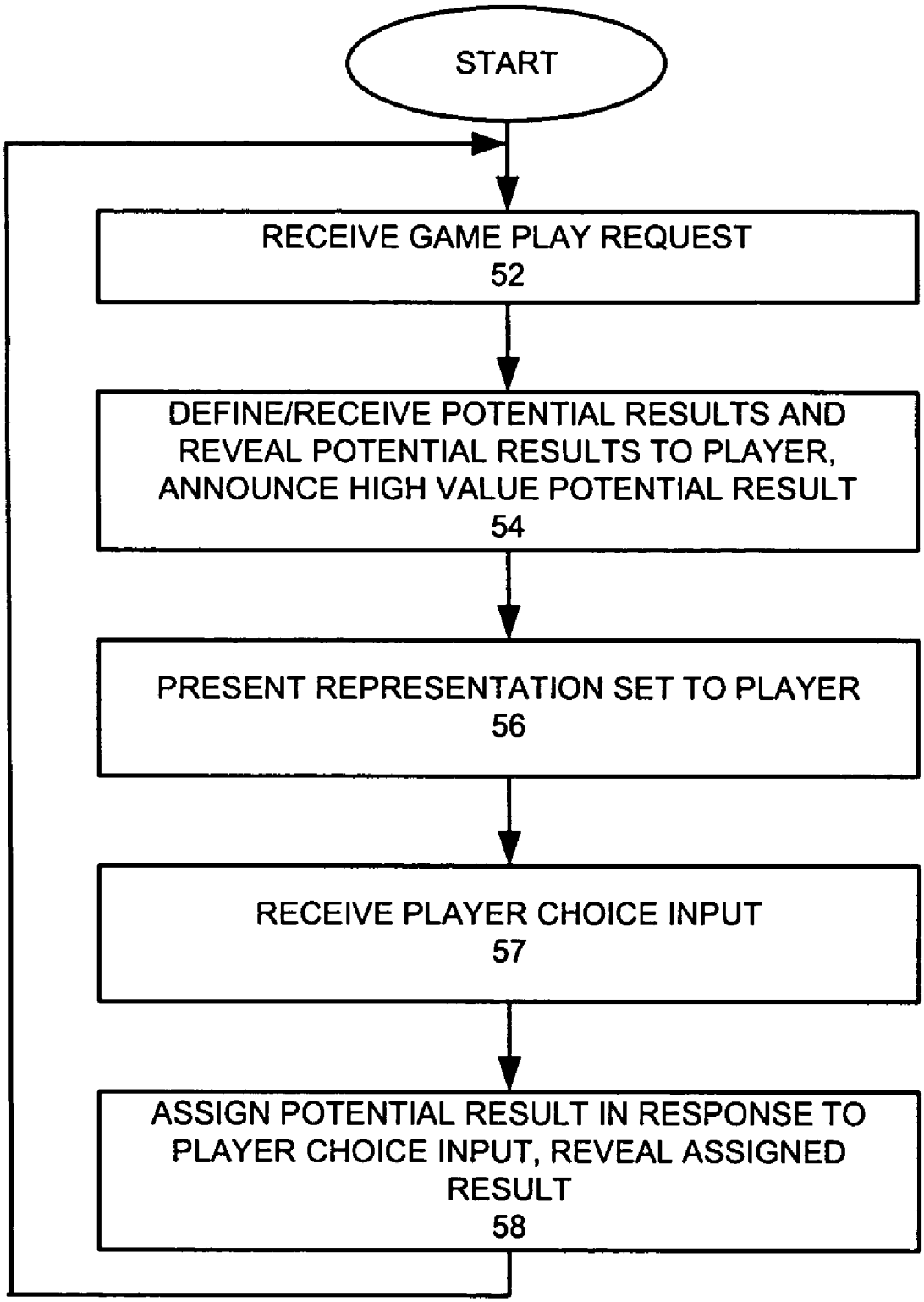
FIG. 4 is a flow chart illustrating an alternate gaming method embodying the principles of the invention.
Figure 5:
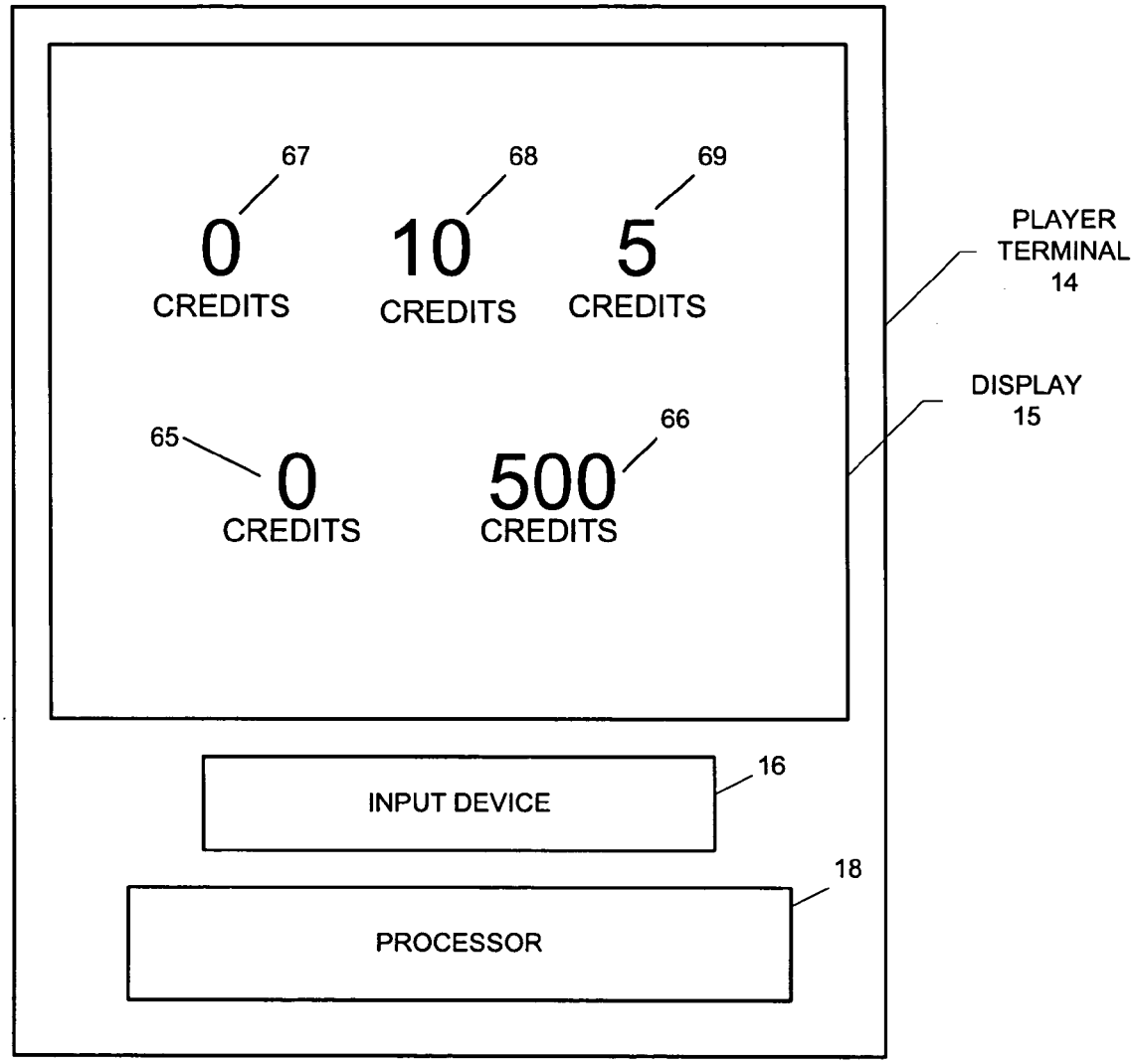
FIG. 5 is a diagrammatic representation of a player terminal and player terminal graphic display that may be used in either of the methods shown in FIGS. 3 and 4 to reveal potential results to a player according to one form of the invention.
Figure 6:
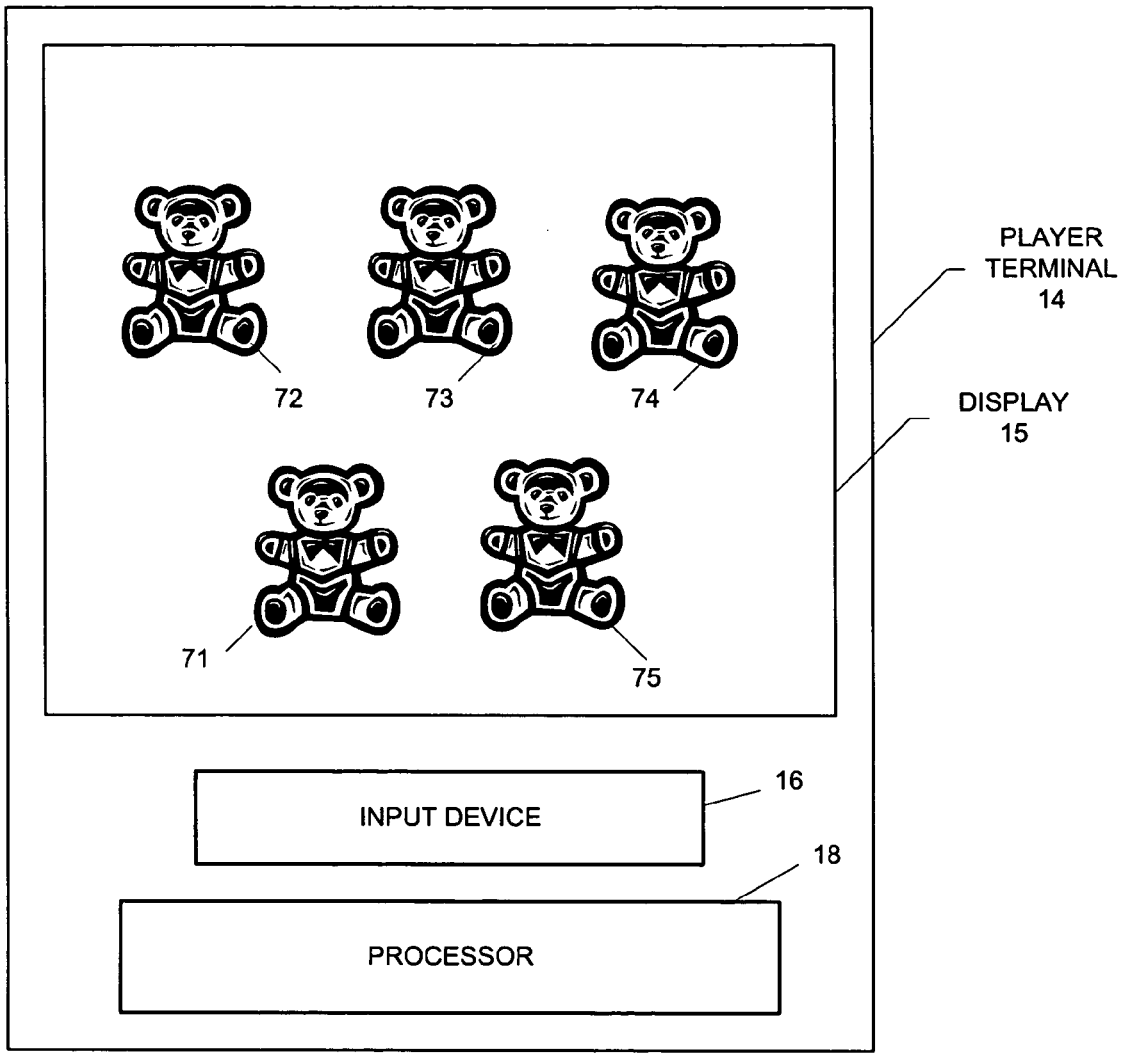
FIG. 6 is a diagrammatic representation similar to FIG. 5 but showing how a set of representations may be presented to a player according to one form of the invention.
Figure 7:
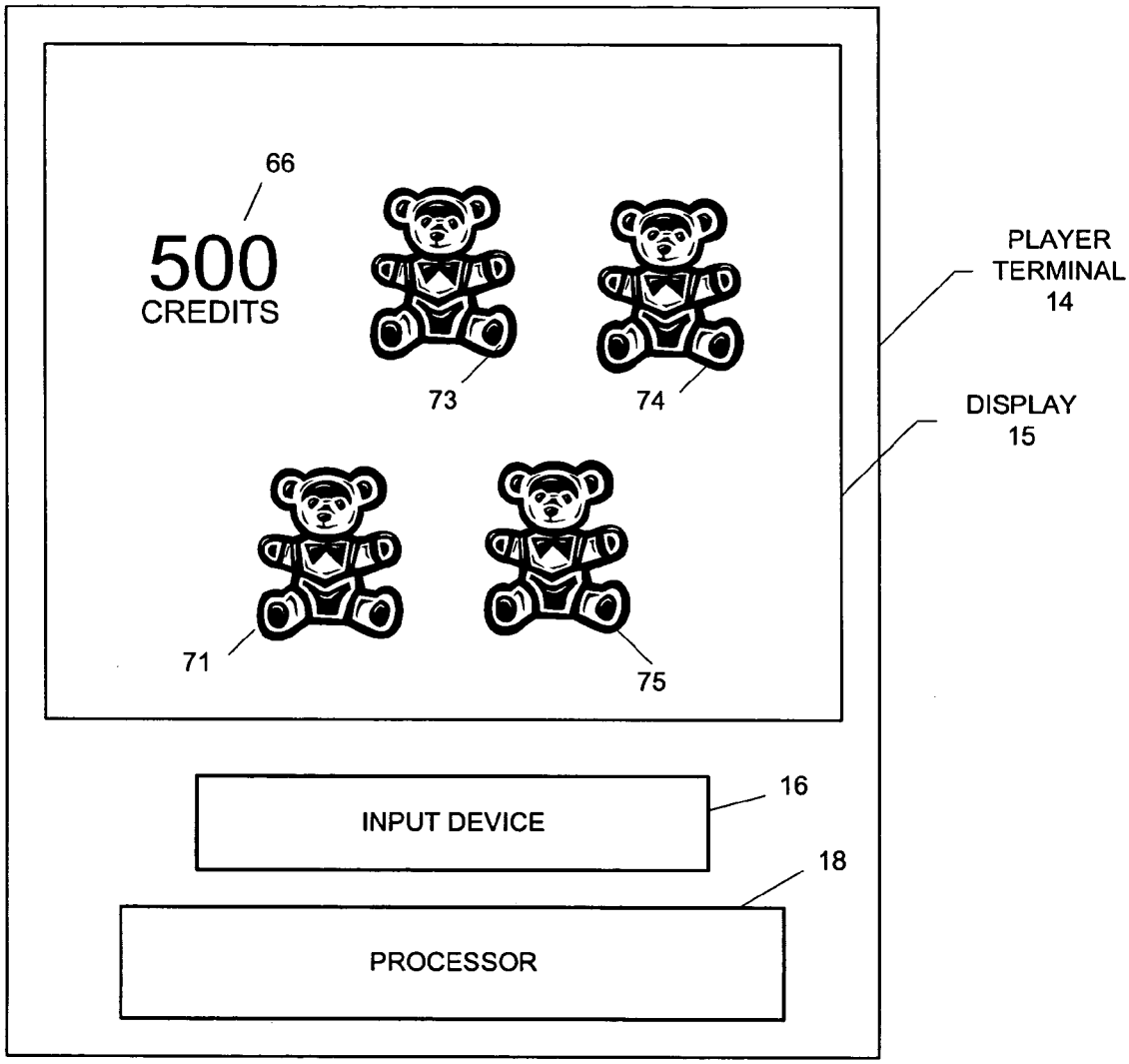
FIG. 7 is a diagrammatic representation similar to FIG. 6 but showing how an assigned result may be revealed to a player according to one form of the invention.

The block diagram in FIG. 3 may be used to describe one preferred method embodying the present invention. FIG. 4 illustrates an alternate method according to the present invention. FIGS. 5, 6, and 7 provide a representation of a player terminal display sequence that may be referenced to illustrate both alternate methods shown in FIGS. 3 and 4. It will be appreciated that the references to system components in the following discussion of FIG. 3 are references to the system components shown in FIGS. 1, 2, 5, 6, and 7. These system components are not illustrated in FIGS. 3 and 4.

Referring now to FIG. 3 a method according to the present invention may be incorporated as bonus round play in a gaming system. This type of game play starts with the receipt of a game play request as indicated at block 42 in FIG. 3. This game play request may be entered through a suitable player input device 16 associated with a player terminal 14 or any other input arrangement associated with the player terminal. In response to this initial game play request, the player terminal 14 receives or generates an initial result as indicated at block 44 in FIG. 3. This initial result may, for example, be a representation of a reel-type or slot machine display showing a particular arrangement of symbols, or a "bonus round" symbol appearing on one of the reels or virtual reels. This bonus round form of the invention is not limited to any particular arrangement or system by which the player reaches the bonus round play or any particular arrangement for displaying the initial result at 44 in FIG. 3. In the lottery-type game example system shown in FIGS. 1 and 2, the initial result may comprise the result associated with a given game play record 25 assigned to the player/player terminal in response to the game play request.

In the method illustrated in FIG. 3, the initial result is evaluated as indicated at decision block 46 to determine whether the initial result entitles the player to bonus round play. If the initial result received or generated at block 44 does not entitle the player to bonus round play, the process returns to wait for the next game play request. However, if the initial result entitles the player to participate in a bonus round according to the present invention, the process continues on to process block 47.

As indicated that process block 47 in FIG. 3, the bonus round includes the step of revealing a limited set a potential results to the player through the player terminal display. A screen graphic revealing potential results according to this step is shown in FIG. 5. In the example of FIG. 5, the limited set a potential results includes five different results labeled by reference numerals 65, 66, 67, 68, and 69. These results are expressed in terms of credits. Potential results 65 and 67 comprise the result 0 credits while potential results 66, 68, and 69 comprise the results 500 credits, 10 credits, and 5 credits, respectively. Although the invention does not require that each result revealed to the player as indicated in FIG. 5 is a result available to the player, the potential results revealed to the player preferably comprise actual results that are available in the game. For example, in a lottery-type gaming system, each potential result may be associated with a game play record from a set of game play records such as those shown at 25 in FIG. 2. Each respective potential result may be associated with a game play record selected from a common set of game play records (24 in FIG. 2) or from different sets of game play records. Alternatively, the potential results revealed to the player as indicated in FIG. 5 may be randomly generated according to some random result generating arrangement executed at the player terminal 14 or some component external to the player terminal such as central system 12 in FIG. 2 and then communicated to the player terminal. This random result generation may be used even where the initial result is a lottery-type result predefined in a game play record 25. As a further alternative, the potential results revealed to the player according to process block 47 in FIG. 3 may be results from one or more bingo games regardless of how the initial result is determined. The invention is not limited to any particular arrangement for defining the potential results revealed to the player. Also, although process block 47 indicates that the potential results are defined at that point in the process, alternative forms of the invention may define the potential results earlier in the process. For example, a number of different limited sets of potential results may be predefined by some suitable process and these predefined sets of potential results may be assigned to the various players by some suitable process. Also, a potential result that may be revealed to the player may comprise a progressive prize and may or may not have a set value at the time it is revealed.

After the limited set the potential results is revealed to the player as indicated at process block 47 in FIG. 3, the method includes presenting to the player a set of representations as indicated at process block 48. FIG. 6 shows an example set of representations made up of the representations shown at reference numerals 71, 72, 73, 74, and 75. It will be appreciated that in preferred forms of the invention there is a one-to-one correspondence between the number of potential results revealed to the player at process block 47 and the number of representations presented to the player as indicated that process block 48 in FIG. 3. However, alternate forms of the invention may not include such a one-to-one correspondence. For example, the set of representations presented as indicated that process block 48 may include more or fewer representations than the number of potential results revealed to the player at process block 47. It will also be appreciated that the example representations, which each comprise a representation of a stuffed animal, are not the only types of representations that may be used according to the present invention. The purpose of the set of representations is to enable the player to choose one or more of the representations by making any player choice input at the player terminal 14. Any arrangement of representations that allows the player or enables the player to make such a selection may be used according to the present invention.

The representations presented to the player according to block 48 in FIG. 3 are ultimately presented to the player in such a way that there is no apparent correspondence between a given representation in the set of representations and a given one of the potential results in the limited set of potential results. This lack of any apparent relationship between a given representation displayed as indicated at FIG. 6 and any result revealed as shown in FIG. 5 means that the player has no way to know which representation to select in order to obtain any particular prize or result. This lack of any apparent relationship between the respective representations 71–75 shown in FIG. 6 and the respective potential results 65–69 shown in FIG. 5 may be accomplished in any number of ways. In one preferred form of the invention the display shown in FIG. 5 simply disappears and is replaced by a display such as that shown in FIG. 6. In another form of the invention, the revealed potential results may be replaced by a set of representations such as the stuffed animal representations 71–75 shown in FIG. 6 and these representations may be shuffled or mixed up rapidly on the display 15 until they reach some final distribution on the display. The player may then make a player choice input to select one of the representations 71–75.

Referring back to FIG. 3 the player choice input is received at block 50. This player choice input may be entered through the input device indicated at 16 in FIGS. 5 and 6 or any other input arrangement. In particular, the player terminal display 15 may comprise a touch screen display, and the player may enter their player choice input by touching one or more of the representations presented on the display. The present invention is not limited to any particular arrangements by which the player may make a selection between the various representations that are presented to the player. In some forms of the invention, the player choice input may not directly select a given representation. Rather, a player choice input may initiate a process that randomly selects one or more of the representations such as representations 71–75 in FIG. 6.

As shown that process block 51 in FIG. 3, the invention includes assigning at least one potential result from the limited set the potential results to the player or to the player terminal in response to the player choice input received at process block 50. FIG. 7 shows an example display that may be produced at the player terminal display 15 in response to the assignment of a potential result according to the invention. In this example the player has made a player choice input which has resulted in the selection of the representation previously displayed as representation 72 in FIG. 6. The assignment step shown at process block 51 in FIG. 3 has assigned the 500 credit prize or result to the player (previously shown as potential result 66 in FIG. 5) and this 500 credit prize or result is revealed to the player as indicated in FIG. 7. The invention encompasses a broad range of variations in the manner in which the assigned potential result or results may be revealed or shown to the player at player terminal 14. FIG. 7 shows simply one preferred arrangement for revealing the assigned potential result. Other forms of the invention may reveal the other potential results after the player choice input or change the display to remove all the remaining representations and display only the assigned result or results. Also, any number of interesting and entertaining graphics may be used to display the potential result or results which have been assigned to the player in response to the player choice input. For example, one preferred form of the invention maintains the limited set of potential results as part of the graphic display even while the representation set is presented, but still giving no indication that any potential result is associated with any given representation. Regardless of how the one or more potential results are assigned at block 51 and revealed to the player, the illustrated preferred process then eventually returns to wait for the next game play request entered at block 42.

The alternate process illustrated in FIG. 4 differs from the process shown in FIG. 3 in that the limited set of potential results is revealed to the player in each instance of the game and not just as an optional bonus round. This alternate form of the invention includes receiving a game play request as indicated at block 52 and then immediately preceding to reveal the limited set of potential results to the player as shown at block 54 in FIG. 4. The limited set the potential results may be revealed to the player as indicated in FIG. 5 or in any other suitable manner.

The alternate process shown FIG. 4 also includes an optional additional action associated with revealing the limited set of potential results to the player at block 54. In particular, this form of the invention includes the step of announcing or broadcasting at least one of the potential results included in the limited set of potential results. This additional step may be taken particularly where one of the potential results in the revealed set includes a high value result. The announcement may be made throughout a gaining facility in which the particular player terminal 14 is located, in a limited area of such a facility, or throughout an entire gaming system network encompassing multiple gaming facilities. The announcement may be made via an audible alarm or message through the various player terminals or otherwise, or may be made by a video presentation on the display 15 associated with each respective player terminal 14 selected to receive the announcement.

The additional step of announcing or broadcasting one of the potential results is particularly useful in generating player excitement where the potential results are defined from sets of lottery-type game play records and in which the game play records that are not selected and assigned to the player are reused to satisfy some other game play request. This reuse of allocated but unassigned game play records in a lottery-type gaming system is disclosed in U.S. provisional patent application No. 60/564,789, filed Apr. 23, 2004 and entitled "Gaming Apparatus and Method for Providing Enhanced Player Participation in Lottery Games." The entire content of this prior application is incorporated herein by this reference. In the situation where unassigned results are reused, an announcement that a high value award has been revealed to a player indicates to other players that a high value award is available and may not be assigned to the player to which it is originally revealed. That is, the high value award may be placed back in the pool of available results and later assigned in response to another game play request. Thus, the announcement of a high value award included in a set of potential results revealed according to the present invention has the effect of encouraging players to quickly make additional game play requests in the hope that the high value award will not be assigned to the original player and will still be available to other players participating in the lottery-type game.

Regardless of whether an announcement/broadcast is made as indicated at block 54, the method next includes presenting the representation set to the player as indicated at block 56 in FIG. 4. The step may be identical to the step shown in block 48 in FIG. 3 as described above in connection with the presentation shown in FIG. 6.

After presenting the representation set to the player as indicated at block 56 in FIG. 4, the method next includes receiving the player choice input as indicated at block 57. This player choice input step corresponds to the step at block 50 in FIG. 3, and the above discussion of block 50 applies equally to the step shown at block 57 in FIG. 4. The method next includes assigning one or more of the potential results from the limited set of potential results in response to the player choice input as indicated at block 58 in FIG. 4. This step shown at block 58 in FIG. 4 corresponds to the step set block 51 in FIG. 3 and the different variations and discussion described in relation to FIG. 3 applies equally to the step indicated at block 58 in FIG. 4.

Numerous variations are possible on the two preferred processes shown in FIGS. 3 and 4. For example, the invention may be implemented so that no separate player choice input is required to assign a potential result to the player. In this case, the player choice input may be made in some automated fashion without any actual player input to select any of the representations presented in accordance with block 48 in FIG. 3 and block 56 in FIG. 4. Also, an actual player choice input according to the invention may be made in some variations within the scope of the invention before the representation set is presented to the player or even before the limited set of potential results is displayed to the player. For example, the player choice input may be for a projected position on a display graphic that may later be filled by a representation and/or a result. In this example, the invention would also not require presenting a set of representations to the player, or alternatively the various locations from which a player may choose may be considered themselves a set of representations or equivalent to a set of representations.

In addition to revealing the limited set of potential results to the player at the player terminal and then presenting the set of representations to the player, a method according to the invention may include initially revealing a correspondence between each potential result and a respective one of the representations. For example, after revealing the limited set of potential results as shown in FIG. 5, the stuffed animal representations, or boxes, or some other graphic elements may appear to be placed over or otherwise conceal the various potential results. Once all of the boxes or other concealing representations are in place to conceal the different potential results, the concealing representations together with the respective concealed results may be quickly randomized on the screen in such a way that the player cannot tell which particular representation winds up at which particular location on the resulting display. The player choice input such as set out at block 50 in FIGS. 3 and 57 in FIG. 4 may then be to select one of these concealing representations. In this concealing process, all of the concealing representations may be identical. However, the invention does encompass the situation in which not all concealing representations in a given set are identical. Any number of entertaining graphics may be used to show an apparent correlation between a given representation in the set of representations and one or more potential results in the limited set the potential results and then randomize the representations on the player terminal display 15 for selection by the player.

It will be appreciated that in preferred forms of the invention the player's choice or selection from the graphic display produced at process block 48 in FIGS. 3 and 56 in FIG. 4 actually effects the result achieved by the player in the game. That is, the player's choice selected from the player terminal display 15 is used in some fashion to select one or more results for the player, whether or not the selection is from the results shown in the limited set of potential results or from a set of results that includes results in addition to those included in the limited set of potential results. However, the presentation of the representation set, that is, the player choice display produced as indicated at process block 48 in FIGS. 3 and 56 in FIG. 4 preferably does not allow the player to know the result that may be associated with each particular selection option.

Another variation within the scope of the present invention relates to the number of times the player may be given an opportunity to make a player choice input in the course of a game play. Although both FIGS. 3 and 4 show only a single sequence of revealing potential results, presenting the representations, and receiving a player choice input, it will be appreciated that a game according to the invention may include several such sequences that are interrelated. For example, the assigned potential result at block 51 in FIG. 3 or 58 in FIG. 4 may be a result that enters the player in another sequence of revealing potential results, presenting a representation set, and receiving a player choice input. Alternatively the assigned potential result at block 51 in FIG. 3 or 58 in FIG. 4 may be a result that enters the player in some different type of game or bonus round.

In yet another variation within the scope of the invention, the player choice input received at block 50 in FIG. 3 and block 57 in FIG. 4, may be associated with a skill or strategy game in which it is the player's skill or strategy that has an effect on which potential result is assigned and not just the player's choice among different representations. For example, the player's choice input may be taken from a skill game such as a marksmanship or driving game and the result assigned to the play may be based at least in part on the player's interaction with the marksmanship or driving game.

It will be appreciated that all of the processes described above with reference to FIGS. 3 and 4 are preferably performed through data processing devices under the control of computer program code. Within the scope of the invention there may be great variation in which particular processing element executes which program. The exemplary lottery-type form of the invention described above may execute potential result assignment program code at central computer system 12 to define the limited set of potential results, produce a potential result reveal command for a player terminal, and cause the potential result reveal command to be communicated to the player terminal. Other forms of the invention, especially forms in which the potential results are produced by a random result generator, may execute the potential result assignment program code at the respective player terminal 14.

Regardless of how potential results are assigned or determined, representation control program code may be executed at the respective player terminal 14 to produce a representation display command. Result assignment program code for assigning one or more game results to the player terminal in response to the player choice input from the player terminal is also preferably executed at the respective player terminal 14. However, both of these program code components or portions of these components may be executed externally to the respective player terminal for a given play according to the invention.

Regardless of other code that may be executed at the respective player terminal 14, player terminal program code may be executed at the respective player terminal for directing display 15 to reveal the limited set of potential results to the player in response to the potential result reveal command and also direct the display to produce the set of representations in response to the representation display command. The player terminal program code executed preferably at the player terminal also handles the receipt of the player choice signal/input, and directs the player terminal display 15 to display the one or more results assigned to the player terminal or player.

The announcement of certain assigned potential results as described above with reference to FIG. 4 is preferably conducted under the control of system announcement program code. This system announcement program code is preferably executed at some central processing device such as the central system 12 shown in FIG. 2.

The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A method including:

(a) revealing a limited set of potential results to a player through a player terminal display associated with a player terminal, each potential result in the limited set of potential results being correlated to a respective game play record included in at least one pool of game play records for a lottery game so that the limited set of potential results defines a number of game play records less than the total number of game play records for the at least one pool of game play records;

(b) presenting the player with a set of representations, each respective representation in the set of representations being presented through the player terminal display and having no apparent relationship to any particular potential result in the limited set of potential results;

(c) enabling the player to select one of the representations by making a player choice input through the player terminal; and (d) assigning to the player one of the potential results in the limited set of potential results in response to the player choice input, the potential result assigned to the player representing an actual result for the player in a game.

2. The method of claim 1 wherein the limited set of potential results includes at least one progressive result that is not necessarily predefined.

3. The method of claim 1 further including the step of defining the limited set of potential results from multiple pools of game play records.

4. The method of claim 1 wherein each representation is associated with a respective one of the potential results in the limited set of potential results and the step of assigning to the player one of the potential results in the limited set of potential results includes assigning to the player a respective potential result associated with a respective representation that the player has selected in the player choice input.

5. The method of claim 1 wherein the step of revealing to the player the limited set of potential results includes revealing an association between each respective potential result and each representation, and wherein the step of presenting the player with the set of representations includes concealing the association between each respective potential result and each representation, and randomizing the location of each representation on the player terminal display.

6. The method of claim 1 further including the step of producing an announcement in a gaming system network in which the player terminal is included, the announcement indicating a value associated with one of the potential results revealed to the player.

7. The method of claim 1 further including the step of displaying the set of potential results concurrently with presenting the player with the set of representations.

8. A gaming system including:

(a) a player terminal including a display and a player input device, the player input device enabling a player to initiate a game play request and to initiate a player choice input;

(b) a potential result assignment arrangement for defining a limited set of potential results and for directing the player terminal to reveal each potential result in the limited set of potential results in response to the game play request, each potential result in the limited set of potential results being defined by selection from at least one pool of game play records for a lottery game so that the limited set of potential results defines a number of game play records less than the total number of game play records for the at least one pool of game play records;

(c) a representation control arrangement for directing the player terminal display to display to the player a set of representations, each respective representation in the set of representations having no apparent relationship to any particular potential result in the limited set of potential results; and (d) a result assignment arrangement for assigning one or more game play results to the player in response to the player choice input, the player choice input selecting at least one of the representations included in the set of representations.

9. The gaming system of claim 8 further including a data storage device for storing the at least one pool of game play records.

10. The gaming system of claim 8 wherein the potential result assignment arrangement includes at least one progressive result in the limited set of potential results.

11. The gaming system of claim 8 wherein the potential result assignment arrangement defines the limited set of potential results from multiple pools of game play records.

12. The gaming system of claim 8 wherein each representation is associated with a respective one of the potential results in the limited set of potential results.

13. The gaming system of claim 8 wherein there is an association between each respective potential result and each representation, and wherein the player terminal display displays the association between each respective representation and the respective potential result, then conceals the association between each respective potential result and each representation, and then randomizes the location of each representation on the player terminal display.

14. The gaming system of claim 8 further including a system announcement arrangement for making a system announcement, the system announcement indicating a value or potential value associated with one of the potential results displayed to the player through the player terminal display.

15. The gaming system of claim 8 wherein the potential result assignment arrangement also directs the player terminal display to display the limited set of potential results concurrently with the set of representations.

16. The gaming system of claim 8 further including a game play record collection arrangement for making at least one unassigned game play record available to satisfy a future game play request, each unassigned game play record comprising a game play record that is defined by the limited set of potential results but remains unassigned to the player in response to the player choice input.

17. A program product stored on a computer readable medium, the program product including:

(a) potential result assignment program code for defining a limited set of potential results and for producing a potential result reveal command for a player terminal and causing the potential result reveal command to be communicated to the player terminal, each potential result in the limited set of potential results being defined by selection from at least one pool of game play records for a lottery game so that the limited set of potential results defines a number of game play records less than the total number of game play records for the at least one pool of game play records;

(b) representation control program code for producing a representation display command for the player terminal and causing the representation display command to be communicated to the player terminal;

(c) result assignment program code for assigning one or more game results to the player terminal in response to a player choice input from the player terminal; and (d) player terminal program code for (i) directing a display associated with the player terminal to reveal the limited set of potential results to the player in response to the potential result reveal command, (ii) directing the display to display a set of representations in response to the representation display command, each respective representation in the set of representations having no apparent relationship to any particular potential result in the limited set of potential results, (iii) receiving a player choice signal from the player choice input at the player terminal, and (iv) directing the display to display the one or more results assigned to the player terminal.

18. The program product of claim 17 wherein the potential result assignment program code defines the limited set of potential results from multiple pools of game play records.

19. The program product of claim 17 wherein each representation displayed at the player terminal display is associated with a respective one of the potential results in the limited set of potential results.

20. The program product of claim 17 wherein there is an association between each respective potential result and each representation, and wherein the representation control program code directs the player terminal display to reveal the association between each respective representation and the respective potential result, then conceal the association between each respective potential result and each representation, and then randomize the location of each representation on the player terminal display.

21. The program product of claim 17 further including system announcement program code for directing the production of a system announcement, the system announcement indicating a value associated with one of the potential results displayed through the player terminal display.

* * * * *